US006758943B2

(12) United States Patent
McConnell et al.

(10) Patent No.: US 6,758,943 B2
(45) Date of Patent: Jul. 6, 2004

(54) METHOD OF MAKING A HIGH UTILITY TISSUE

(75) Inventors: Wesley James McConnell, Alpharetta, GA (US); Jay Chiehlung Hsu, Alpharetta, GA (US); Joseph Mitchell, Alpharetta, GA (US); Sheng-Hsin Hu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 272 days.

(21) Appl. No.: 10/034,881

(22) Filed: Dec. 27, 2001

(65) Prior Publication Data

US 2003/0131960 A1 Jul. 17, 2003

(51) Int. Cl.[7] ..... D21H 17/04; D21H 21/16; D21H 21/22

(52) U.S. Cl. ..... 162/158; 162/109; 162/111; 162/179; 162/180; 162/173; 162/172; 162/183

(58) Field of Search ..... 162/109, 111, 162/158, 179, 180, 171, 172, 173, 183

(56) References Cited

U.S. PATENT DOCUMENTS

| | | | | | |
|---|---|---|---|---|---|
| 1,682,346 | A | * | 8/1928 | Lorenz | 162/112 |
| 3,598,696 | A | | 8/1971 | Beck | |
| 3,695,985 | A | | 10/1972 | Brock et al. | |
| 3,903,342 | A | | 9/1975 | Roberts, Jr. | |
| 3,953,638 | A | | 4/1976 | Kemp | |
| 4,075,382 | A | | 2/1978 | Chapman et al. | |
| 4,100,017 | A | | 7/1978 | Flautt, Jr. | |
| 4,113,911 | A | | 9/1978 | LaFitte et al. | |
| 4,145,464 | A | | 3/1979 | McConnell et al. | |
| 4,166,001 | A | | 8/1979 | Dunning et al. | |
| 4,196,245 | A | | 4/1980 | Kitson et al. | |
| 4,207,367 | A | | 6/1980 | Baker, Jr. | |
| 4,239,792 | A | | 12/1980 | Ludwa | |
| 4,287,251 | A | | 9/1981 | King et al. | |
| 4,298,649 | A | | 11/1981 | Meitner | |
| 4,326,000 | A | | 4/1982 | Roberts, Jr. | |
| 4,377,615 | A | | 3/1983 | Suzuki et al. | |
| 4,436,780 | A | | 3/1984 | Hotchkiss et al. | |
| 4,445,974 | A | | 5/1984 | Stenberg | |
| 4,469,735 | A | | 9/1984 | Trokhan | |
| 4,537,822 | A | | 8/1985 | Nanri et al. | |
| 4,548,856 | A | | 10/1985 | Ali Khan et al. | |
| 4,610,915 | A | | 9/1986 | Crenshaw et al. | |
| 4,618,524 | A | | 10/1986 | Groitzsch et al. | |
| 4,816,320 | A | * | 3/1989 | St. Cyr | 428/198 |
| 4,885,202 | A | | 12/1989 | Lloyd et al. | |
| 4,940,513 | A | * | 7/1990 | Spendel | 162/112 |
| 5,048,589 | A | | 9/1991 | Cook et al. | |
| 5,062,973 | A | * | 11/1991 | Kellett | 510/519 |
| 5,087,324 | A | | 2/1992 | Awofeso et al. | |
| 5,192,388 | A | | 3/1993 | Schöllkopf et al. | |
| 5,354,425 | A | * | 10/1994 | Mackey et al. | 162/135 |
| 5,385,642 | A | * | 1/1995 | Van Phan et al. | 162/112 |
| 5,397,435 | A | * | 3/1995 | Ostendorf et al. | 162/112 |
| 5,399,412 | A | | 3/1995 | Sudall et al. | |
| 5,404,501 | A | * | 4/1995 | Carr et al. | 709/314 |
| 5,494,731 | A | * | 2/1996 | Fereshtehkhou et al. | 428/211 |
| 5,527,560 | A | * | 6/1996 | Fereshtehkhou et al. | 427/288 |
| 5,529,665 | A | * | 6/1996 | Kaun | 162/111 |
| 5,538,595 | A | * | 7/1996 | Trokhan et al. | 162/123 |
| 5,543,202 | A | | 8/1996 | Clark et al. | |
| 5,573,637 | A | * | 11/1996 | Ampulski et al. | 162/112 |
| 5,601,871 | A | * | 2/1997 | Krzysik et al. | 427/288 |
| 5,607,551 | A | | 3/1997 | Farrington, Jr. et al. | |
| 5,616,207 | A | | 4/1997 | Sudall et al. | |
| 5,620,565 | A | | 4/1997 | Lazorisak et al. | |
| 5,716,498 | A | * | 2/1998 | Jenny et al. | 162/158 |
| 5,753,079 | A | * | 5/1998 | Jenny et al. | 162/158 |
| 5,981,044 | A | * | 11/1999 | Phan et al. | 428/212 |
| 6,027,611 | A | * | 2/2000 | McFarland et al. | 162/127 |
| 6,077,393 | A | | 6/2000 | Shannon et al. | |
| 6,126,784 | A | * | 10/2000 | Ficke et al. | 162/184 |
| 6,179,961 | B1 | * | 1/2001 | Ficke et al. | 162/127 |
| 6,207,012 | B1 | * | 3/2001 | Oriaran et al. | 162/111 |
| 6,228,895 | B1 | * | 5/2001 | Buchanan et al. | 516/72 |
| 6,261,580 | B1 | * | 7/2001 | Lehrter et al. | 424/402 |
| 6,268,028 | B1 | * | 7/2001 | Buchanan et al. | 428/34.2 |
| 6,296,737 | B1 | * | 10/2001 | Wu et al. | 162/164.1 |
| 6,322,665 | B1 | * | 11/2001 | Sun et al. | 162/158 |
| 6,332,952 | B1 | | 12/2001 | Hsu et al. | |
| 6,344,111 | B1 | * | 2/2002 | Wilhelm | 162/117 |
| 6,420,013 | B1 | * | 7/2002 | Vinson et al. | 428/154 |
| 6,458,243 | B1 | * | 10/2002 | Jones et al. | 162/127 |
| 6,488,812 | B2 | * | 12/2002 | Shannon et al. | 162/164.6 |
| 6,544,386 | B1 | * | 4/2003 | Krzysik et al. | 162/123 |
| 6,579,416 | B1 | * | 6/2003 | Vinson et al. | 162/158 |

FOREIGN PATENT DOCUMENTS

| | | |
|---|---|---|
| EP | 0144658 A1 | 6/1984 |
| GB | 1372787 | 11/1974 |
| WO | 00/43429 | 7/2000 |
| WO | 01/44571 A2 | 6/2001 |

* cited by examiner

*Primary Examiner*—José A. Fortuna
(74) *Attorney, Agent, or Firm*—Sue C. Watson

(57) ABSTRACT

A toilet tissue product which having a cellulosic ply having at least one layer incorporating a repellant agent and a debonder which are each substantially dispersed throughout the layer. The layer is configured to provide a substantially homogeneous structure having increased absorbency rate and a reduced dry tensile strength. Methods of making a toilet tissue product having an increased absorbency rate and a reduced dry tensile strength.

16 Claims, 2 Drawing Sheets

METHOD OF MAKING A HIGH UTILITY TISSUE

FIELD OF THE INVENTION

This invention generally relates to the field of paper making, and more specifically, to a tissue with strikethrough resistance.

BACKGROUND

A user often uses more tissue than necessary, especially after urination. The user often uses excessive tissue to prevent urine or other liquid from passing from one side of the tissue to the opposite side, next to the user's hand. Using excessive tissue results in tissue waste, which expends economic resources and degrades the environment.

Accordingly, a tissue product that has a relatively long absorbency rate to delay liquid from saturating the tissue and pass from one side of the tissue to the other, would be desirable. In addition, such a tissue product would have a reasonable absorbency capacity to absorb liquid. The tissue product would also, ideally, break up relatively rapidly after being immersed in liquid. Such a tissue product having these attributes would reduce tissue consumption waste while addressing economic and environmental issues.

DEFINITIONS

As used herein, the term "repellant agent" refers to an agent that resists absorption of a liquid, desirably an aqueous liquid. The repellant agent may repel liquids by filling interstitial voids in the fibrous structure of a tissue or by coating individual fibers thereby preventing liquids from being absorbed by and passing through the fibers to the interior of the fibrous structure, as measured by test procedure ASTM D 779-94. When repellant action is accomplished, the contact angle at the fiber surface is about 90 degrees or greater, as measured by test procedure ASTM D 5725-95 or TAPPI Test Method T-458. The repellant agent is preferably a hydrophobic chemical, and may include other materials, such as sizing agents, waxes, and latexes, may also be included. When included, the amounts of the other materials comprise less than 20% of the total composition of the repellant agent, preferably less than 10% of the total composition of the repellant agent, and more preferably less than 5% of the total composition of the repellant agent, and even more preferably less than 2% of the total composition of the repellant agent. By way of example only, a suitable repellant agent is a hydrophobic chemical having a primary composition comprising mono- and distearamides of aminoethylethanolamine, such as:

$$C_{17}H_{35}CONHCH_2CH_2NHCH_2CH_2OH$$

or $$(C_{17}H_{35}C0)_2NCH_2CH_2NHCH_2CH_20H$$

One such agent is sold under the trade name REACTO-PAQUE (hereinafter "RO") by Sequa Chemicals, Inc., at One Sequa Dr., Chester, S.C. 29706. The amount of repellant agent added to the fibers may be from about 2 to about 20 pounds of active ingredient per ton of fiber, more specifically from about 3 to about 15 pounds of active ingredient per ton of fiber, still more specifically, from about 4 to about 12 pounds of active ingredient per ton of fiber, and even more specifically, from about 6 to about 10 pounds of active ingredient per ton of fiber.

As used herein, the term "latex" refers to a colloidal water dispersion of high polymers from sources related to natural rubber, such as Hevea tree sap, or of synthetic high polymers that resemble natural rubber. Synthetic latexes may be made by emulsion polymerization techniques from styrene-butadiene copolymer, acrylate resins, polyvinyl acetate, and other materials.

As used herein, the term "wax" refers to aqueous emulsions of small particles held in suspension by emulsifying agents and may include materials such as paraffin waxes, microcrystalline wax, or other waxes.

As used herein, the term "sizing agent" refers to any chemical inhibiting liquid penetration to cellulosic fiber structures. Suitable sizing agents are disclosed in a test entitled, "Papermaking and Paper Board Making"" second edition, Volume III, edited by R. G. Macdonald, and J. N. Franklin, which is hereby incorporated by reference herein.

As used herein, the term "strikethrough resistance" refers to a characteristic of a tissue product which slows or impedes the movement of liquid from one surface of the tissue to the opposite surface. Such a tissue product has a relatively high absorbency rate, i.e., of at least 10 seconds, but still has a reasonable gms/gms absorbency capacity. For example, a tissue product having a basis weight of about 10 gsm to about 35 gsm, and more desirably about 27 gsm, may have an absorbency rate desirably between about 10 seconds to about 430 seconds, and more desirably between about 10 seconds and about 30 seconds, and an absorbency capacity desirably between about 7 gms/gms to about 13 gms/gms. In another example, a tissue product having a basis weight of about 10 gsm to about 45 gsm, and more desirably, about 33 gsm (each ply having a basis weight of about 16 gsm), may have an absorbency rate desirably between about 10 seconds to about 430 seconds, and still more desirably between about 10 seconds to about 30 seconds, and may have an absorbency capacity desirably between about 7 gms/gms to about 13 gms/gms.

As used herein, the term "layer" refers to a single thickness, course, stratum, or fold that may lay or lie on its own, or, that may lay or lie over or under another.

As used herein, the term "ply" refers to a material having one or more layers. An exemplary toilet tissue product having a single ply structure is illustrated in FIGS. 1–2; an exemplary toilet tissue product having a two-ply structure is depicted in FIG. 3.

As used herein, the term "cellulosic material" refers to material that may be prepared from cellulose fibers from synthetic sources or natural sources, such as woody and non-woody plants. Woody plants include, for example, deciduous and coniferous trees. Non-woody plants include, for example, cotton, flax, esparto grass, milkweed, straw, jute, hemp, and begasse. The cellulose fibers may be modified by various treatments such as, for example, thermal, chemical, and/or mechanical treatments. It is contemplated that reconstituted and/or synthetic cellulose fibers maybe used and/or blended with other cellulose fibers of the fibrous cellulosic material. Desirably, no synthetic fibers are woven into the cellulosic fibers.

As used herein, the term "pulp" refers to cellulosic fibrous material from sources such as woody and non-woody plants. Woody plants include, for example, deciduous and confierous trees. Non-woody plants include, for example, cotton, flax, esparto grass, milkweed, straw, jute, hemp, and bagasse. Pulp may be modified by various treatments such as, for example, thermal, chemical and/or mechanical treatments. Desirably, no synthetic fibers are woven into the pulp fibers.

As used herein, the term "basis weight" (hereinafter may be referred to as "BW") is the weight per unit area of a sample and may be reported as gram-force per meter squared. The basis weight may be measured using test procedure ASTM D 3776-96 or TAPPI Test Method T-220.

As used herein, the term "wet strength agent" refers to a "temporary" wet strength agent. For purposes of differentiating permanent from temporary wet strength, permanent will be defined as those resins which, when incorporated into paper or tissue products, will provide a product that retains more than 50% of its original wet strength after exposure to water for a period of at least five minutes. Temporary wet strength agents are those which show less than 50% of their original wet strength after exposure to water for five minutes. Only temporary wet strength agents find application in the present invention. The amount of wet strength agent added to the pulp fibers can be at least about 0.1 dry weight percent, more specifically from about 0.2 dry weight percent or greater, and still more specifically from about 0.1 to about 3.0 dry weight percent based on the dry weight of the fibers.

The temporary wet strength resins that can be used in connection with this invention include, but are not limited to, those resins that have been developed by American Cyanamid and are marketed under the name PAREZ 631-NC (now available from Cytec Industries, West Paterson, N.J.). This and similar resins are described in U.S. Pat. No. 3,556,932 to Cosica et al. and U.S. Pat. No. 3,556,933 to Williams et al. Other temporary wet strength agents that should find application in this invention include a dry strength starch such as those available from National Starch and marketed under the tradename REDI-BOND 2005. It is believed that these and related starches are covered by U.S. Pat. No. 4,675,394 to Solarek et al. Derivatized dialdehyde starches, such as described in Japanese Kokai Tokkyo Koho JP 03,185,197, should also find application as useful materials for providing temporary wet strength. It is expected that other temporary wet strength materials such as those described in U.S. Pat. Nos. 4,981,557; 5,008,344 and 5,085,736 to Bjorkquist would be of use in this invention. With respect to the classes and the types of wet strength resins listed, it should be understood that this listing is simply to provide examples and that this is neither meant to exclude other types of temporary wet strength resins, nor is it meant to limit the scope of this invention.

The term "debonder" or "debonder agent" refers to any chemical that can be incorporated into paper products such as tissue to prevent or disrupt interfiber or intrafiber hydrogen bonding. Desirable chemical debonder agents include fatty chain quaternary ammonium salts (QAS) made by Eka Nobel, Inc. Marietta, Ga., or compounds made by Witco Corp., Melrose Park, Ill. One debonder agent from Witco Corp. often used is C-6027, an imidazoline QAS. Other QAS compounds from Witco Corp. which may be used include ADOGEN 444, a cethyl trimethyl QAS, VARISOFT 3690PG, an imadazoline QAS, or AROSURF PA 801, a blended QAS.

As used herein, "Absorbent Capacity" refers to the amount of distilled water that an initially 4 by 4-inch (+/−0.01 in.) of cellulose material can absorb while in contact with a pool 2 in. deep of room-temperature (23+/−2° C.) distilled water for 3 minutes +/−5 seconds in a standard laboratory atmosphere of 23+/−1° C. and 50+/−2% RH and still retain after being removed from contact with liquid water and being clamped by a one-point clamp to drain for 3 minutes +/−5 seconds. Absorbent capacity is expressed as grams of water held per gram of dry fiber, as measured to the nearest 0.01 g.

As used herein, the "Absorbency Rate" is a measure of the water repellency imparted to the tissue by the repellant agent. The Absorbency Rate is the time it takes for a product to be thoroughly saturated in distilled water. To measure the Absorbency Rate, samples are prepared as 3 inch squares composed of 2 different product sheets. In this instance the sheets in Examples 1A to 1E are from one product having a 1-ply sheets having a single blended layer; the sheets from Examples 2A to 2E are from a product having two 2-ply sheets having two identical layers. Six (6) sheets are conditioned by placing them in an oven at 105° C. for 5 minutes. The samples are draped over the top of a 250 ml beaker and covered with a 5 by 5 in. template having a 2 in. diameter opening. An amount of distilled water is dispensed from a pipette (0.01 cc for 1-ply samples; 0.1 cc for 2-ply samples) positioned 1 in. above the sample and at a right angle to the sample, and a timer accurate and readable to 0.1 sec. is started when the water first contacts the sample. The timer is stopped when the fluid is completely absorbed. At least six samples are tested; two readings are taken from one side of the sample(s), and two readings are taken from the opposite side. The end point of timing is reached when the fluid is absorbed to the point where light is not reflecting from the surface of the water on the sample. Results are recorded to the nearest 0.1 sec. The absorbency rate is the average of the four absorbency readings (the two on one side and the two on the other side of the sample). A minimum of six samples are tested and the test results are averaged. All tests are conducted in a laboratory atmosphere of 23+/−1° C. and 50+/−2% RH, and all samples are stored under these conditions for at least 4 hours before testing.

As used herein, "additives" refers to any agent of substance incorporated in or sprayed on pulped fibers during the papermaking process, such as, but not by way of limitation, sizing agent(s), wax(es), latex(es), (temporary) wet strength agent(s), and so forth.

As used herein, the term "machine direction" is the direction of a material parallel to its forward direction during processing.

As used herein, the term "cross direction" is the direction of a material perpendicular to its machine direction.

As used herein, the term "machine direction tensile" (hereinafter may be referred to as "MDT") is the breaking force in the machine direction required to rupture a one or three inch width specimen and may be reported as gram-force.

As used herein, the term "cross direction tensile" (hereinafter may be referred to as "CDT") is the breaking force in the cross direction required to rupture a one or three inch specimen and may be reported as gram-force.

As used herein, the term "GMT" refers to geometric mean tensile strength, which is the square root of the product of the machine direction tensile strength and the cross-machine direction tensile strength of the web. Unless otherwise indicated, the term "tensile strength" means "geometric mean tensile strength." Tensile strengths are measured using a standard Instron tensile tester having a 2-inch jaw span using 3-inch wide strips of tissue under TAPPI conditions (23+/−1° C. and 50+/−2% RH), with the tensile test run at a crosshead speed of 10 (+/−0.4) in/min. after maintaining the sample under TAPPI conditions for 4 hours before testing.

SUMMARY OF THE INVENTION

A toilet tissue product is provided, which comprises a cellulosic ply having at least one layer incorporating a repellant agent and a debonder. The repellant agent and the debonder are each dispersed substantially uniformly throughout the layer. The layer is configured to provide a substantially homogeneous structure having an increased absorbency rate of at least 10 seconds with a reduced dry tensile strength to provide rapid dissolution of the layer when it is immersed in liquid.

A method for making a toilet tissue product in a wet-end stock system including a chest and a headbox is also provided. An aqueous suspension comprising papermaking fibers is provided. A repellant agent and a debonder are added to the aqueous suspension of papermaking fibers prior to forming a web. The repellant agent and the debonder are substantially uniformly dispersed throughout the aqueous suspension of papermaking fibers. The aqueous suspension of papermaking fibers are then deposited onto a forming fabric to form a web having a substantially homogeneous structure. The web is dried to form a toilet tissue product having an increased absorbency rate of at least 10 seconds with a reduced dry tensile strength.

DETAILED DESCRIPTION

While the invention will be described in connection with preferred embodiments, it will be understood that it is not intended to limit the invention to these embodiments. On the contrary, it is intended to cover all alternatives, modifications, and equivalents as may be included within the spirit and scope of the invention as defined by the appended claims.

It has been discovered that a toilet tissue product can be manufactured to substantially delay moisture penetration without deleteriously affecting the softness or increasing the stiffness of the tissue. In addition, it has been unexpectedly discovered that certain repellant agents, such as hydrophobic chemicals, when combined with debonders, substantially delay moisture penetration while retaining a reasonable moisture capacity, reduce dry tensile strength to promote rapid beakdown when immersed in liquid when discarded in a toilet bowl. A synergistic effect occurs and/or a desirable combination of properties are achieved when a repellant agent comprising a hydrophobic chemical is combined, in sufficient quantities, with a debonder. When the dry tensile strength of the debonder is lowered sufficiently, which occurs in the present invention, such reduction in dry tensile strength also reduces wet tensile strength, resulting in rapid dissolution of the tissue when immersed in liquid.

Figure 1:
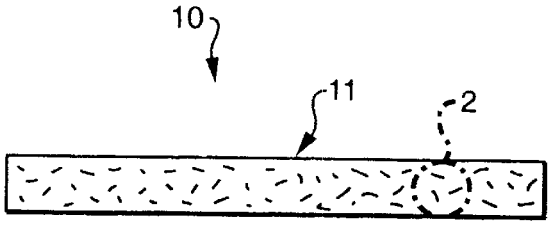
FIG. 1 is a magnified, but not necessarily to scale, schematic side elevational view of one embodiment of a toilet tissue product having a homogeneous single ply.
Figure 2:
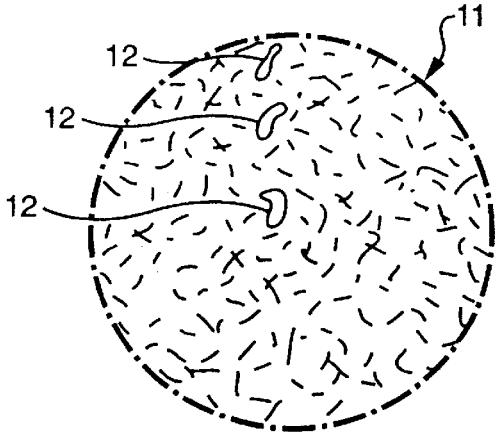
FIG. 2 is a schematic magnified sectional view of FIG. 1 taken along line 2 showing a liquid moving slowly through the fibers of the ply.

Referring now to FIG. 1, an embodiment of one toilet tissue product 10 is illustrated. The toilet tissue product 10 may include one or more cellulosic plies, each ply having one or more layers, however, FIGS. 1 and 2 illustrate one cellulosic ply 11 which is formed from one blended layer. The ply 11 may be formed from pulp fibers using any suitable papermaking techniques, and one such exemplary technique will be hereinafter described.

A repellant agent, preferably a hydrophobic chemical, is incorporated into the ply 11 during the papermaking process. In addition, a debonder is also incorporated into the ply 11 during the papermaking process. The repellant agent and the debonder are dispersed generally uniformly throughout the ply 11, resulting in a ply having a homogeneous structure. The repellant agent acts to form a liquid or fluid strikethrough barrier throughout the homogeneous structure which delays the penetration of moisture through the ply, as illustrated in FIG. 2. It will be appreciated that other additives, such as, for example, temporary wet strength agents, sizing agents, and so forth may also be incorporated into the ply 11 during the during the papermaking process. The resulting ply 11 is a ply having delayed wetting and reduced dry tensile strength throughout the ply.

The repellant agent coats the individual fibers to prevent or delay liquids from being absorbed by the individual fibers and into the interior of the fibrous structure, as shown schematically in FIG. 2, where liquid droplets 12 are schematically shown winding there way through the individual fibers of the homogeneous structure to reach the opposite surface of the ply 11. The repellant agent acts by interfiber penetration through the capillaries, or pores, in the tissue product, or by intrafiber diffusion through the cellulose.

As a ply 11 having a homogeneous structure, additional equipment, as disclosed, for example, in U.S. Pat. No. 6,027,611, previously incorporated by reference herein, required to spray one or more substances or additives on one or more surfaces of a toilet tissue product, or to form one or more heterogeneous layers or plies, is unnecessary. Therefore, a toilet tissue product 10 is provided which requires less equipment, thereby providing decreased manufacturing costs. The single ply 11 shown in FIGS. 1 and 2 is formed generally in accordance with the ply formed in Example 1A.

The basis weight of the tissue product 10 may vary and desirably varies between about 4 grams per square meter (hereinafter abbreviated "gsm") to about 60 gsm, and still more desirably varies between about 10 gsm to about 35 gsm, and more often is about 27 gsm. The absorbency rate desirably is between about 10 seconds to about 430 seconds, and still more desirably is between about 10 seconds to about 30 seconds. The absorbency capacity is desirably between about 7 gms/gms to about 13 gms/gms, more desirably, is between about 8 gms/gms to about 12 gms/gms, and even more desirably, is between about 11 gms/gms to about 12 gms/gms. The tensile strength (GMT) desirably is between about 200 g/3 in. to about 700 g/3 in., and more desirably between about 300 g/3 in. to about 600 g/3 in.

Figure 3:
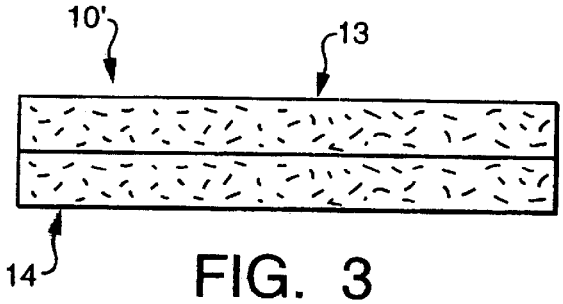
FIG. 3 is a magnified, but not necessarily to scale, schematic side elevational view of another embodiment of a toilet tissue product having two homogeneous plies.

Another toilet tissue product 10' has two plies 13, 14 is illustrated in FIG. 3. Both plies 13, 14 are bonded together to form the toilet tissue product 10'. Both plies 13, 14 are homogenous plies incorporating both a repellant agent and a debonder, as described for ply 11 previously.

The basis weight of the two ply tissue product 10' may vary, and desirably varies between about 8 gsm to about 60 gsm, and desirably varies between about 10 gsm to about 45 gsm, and more desirably is about 33 gsm. As an example, each ply 13, 14 may have a basis weight of about 16 gsm. The absorbency rate desirably is between about 10 seconds to about 430 seconds, and still more desirably is between about 10 seconds to about 30 seconds. The absorbency capacity is desirably between about 7 gms/gms to about 13 gms/gms, more desirably between about 8 gms/gms to about 12 gms/gms, and even more desirably between about 8 gms/gms to about 10 gms/gms. The tensile strength (GMT) desirably is between about 200 g/3 in. to about 700 g/3 in., and more desirably between about 300 g/3 in. to about 650 g/3 in.

The amount of repellant agent used is desirably between about 1 pound to about 20 pounds of active agent per ton of fiber. More desirably, the amount is between about 3 pounds and about 9 pounds of active agent per ton of fiber, and even more desirably, between about 4 pounds to about 8 pounds of active agent per ton of fiber. The amount of debonder used in combination with the repellant agent is desirably between about 1 pound and about 10 pounds of active agent per ton of fiber. More desirably, the amount is between about 1.5 pounds and about 6 pounds of active agent per ton of fiber, and even more desirably, between about 2 pounds to about 4 pounds of active agent per ton of fiber.

The toilet tissue products 10 and 10' of the present invention, unlike conventional facial tissues, do not contain permanent wet strength binder materials. Wet strength binder materials include polyamide-epichlorohydrin, polyacrylamides, styrenebutadien latexes, insolubilized polyvinyl alcohol, urea-formaldehyde, plyethyleneimine, chitosan polymers, and mixtures thereof. Generally, it is undesirable to add permanent wet strength binder materials to toilet tissue because these materials impede the dissolution of the tissue in a toilet bowl.

Moreover, temporary wet strength binders have significant dry strength but reduced wet strength, to permit the rapid dissolution of the tissue when disposed in the toilet bowl. Temporary wet strength binders which have a reduced amount of dry tensile strength are desirable, but must provide sufficient strength while dry for use, and retain "temporary wet strength" for a few seconds until disposed of.

Figure 4:
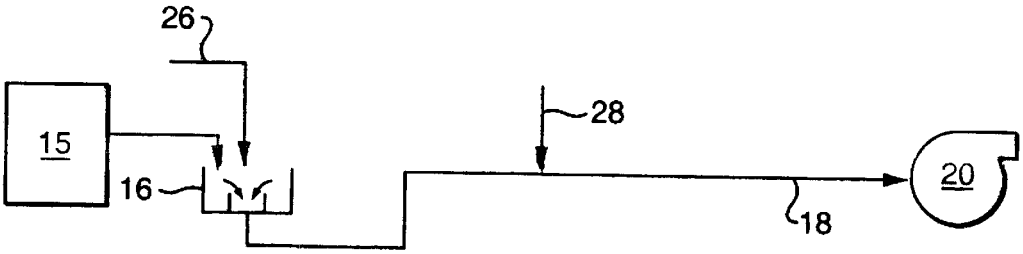
FIG. 4 is a schematic flow diagram of a wet-end stock system useful for purposes of this invention.

The ply 11 illustrated in FIGS. 1 and 2 may be formed using any suitable papermaking techniques, and one such exemplary technique will be hereinafter described. A wet-end stock system which could be used in the manufacture of a sized toilet tissue product is illustrated in FIG. 4. The wet-end stock system includes a chest 15 for storage of an aqueous suspension of papermaking fibers. From chest 15, the fiber-water suspension enters stuffbox 16 used to maintain a constant pressure head. Often, the entire outlet of the stuffbox 16 is sent via outlet stream 18 to a fan pump 20. Alternatively, however, a portion of the outlet stream 17 of the stuffbox 16 can be drawn off as a separate stream and sent to the fan pump 20 while the remaining portion can be recirculated back to the stuffbox 16, as disclosed in U.S. Pat. No. 6,027,611 to McFarland et al., which is hereby incorporated by reference herein.

The repellant agent and debonder may be added at any point between the chest 15 and the headbox 24 (FIG. 5), such as, for example, additive points 26 or 28, shown in FIG. 4. The optional sizing agent addition point is specific to the type of sizing agent used. Alternatively, no sizing agent is added to the suspension. Additionally, the stock can be passed through a refiner, as disclosed in U.S. Pat. No. 6,027,611, previously incorporated by reference herein.

Figure 5:
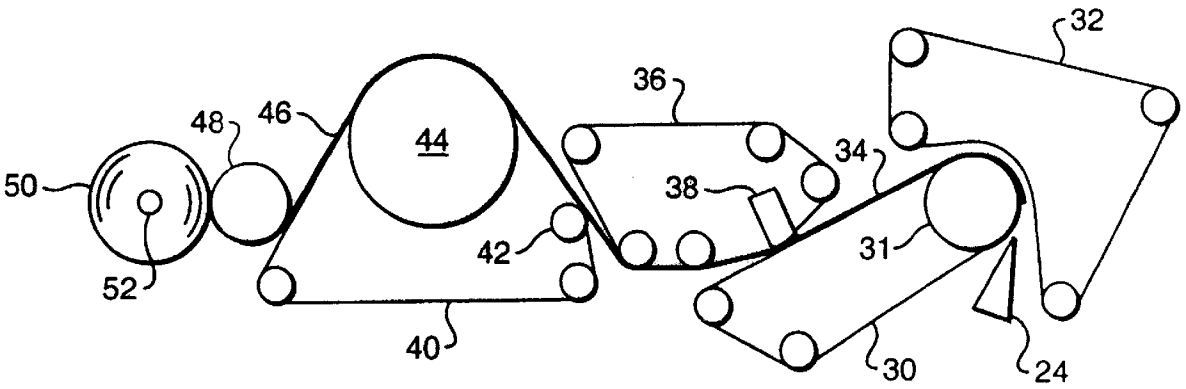
FIG. 5 is a schematic flow diagram of an uncreped throughdried tissue making process in accordance with this invention.

A schematic process flow diagram of the machine used to manufacture a sized toilet tissue product is illustrated in FIG. 5. The machine includes headbox 24 which receives the discharge or outlet stream 16 from the fan pump 20 and continuously injects or deposits the aqueous paper fiber suspension onto an inner forming fabric 30 as it traverses a forming roll 31. An outer forming fabric 32 serves to contain the web while it passes over the forming roll 31 and sheds some of the water. The wet web 34 is then transferred from the inner forming fabric 30 to a wet end transfer fabric 36 with the aid of a vacuum transfer shoe 38. This transfer is preferably carried out with the transfer fabric 36 travelling at a slower speed than the inner forming fabric 30 (rush transfer) to impart stretch into the final tissue product. The wet web 34 is then transferred to the throughdrying fabric 40 with the assistance of a vacuum transfer roll 42. The throughdrying fabric 40 carries the wet web 34 over the throughdryer 44, blowing hot air through the web 34 to dry it while preserving bulk. There optionally can be more than one throughdryer in series (not shown), depending on the speed and the dryer capacity. The dried toilet tissue sheet 46 is then transferred to a reel drum 48 directly from the throughdrying fabric 40. The transfer is accomplished using vacuum suction from within the reel drum 48 and/or pressurized air. The toilet tissue sheet 46 is then wound into a roll 50 on a reel 52. U.S. Pat. No. 5,591,309 to Rugowski et al., which is hereby incorporated by reference herein, discloses the same and additional techniques for throughdrying a wet-laid sheet, as does U.S. Pat. Nos. 5,399,412 to Sudall et al. and 5,048,589 to Cook et al., both of which are also hereby incorporated by reference herein.

The toilet tissue 10' having plies 13, 14 illustrated in FIG. 3 may be formed using any suitable papermaking techniques, and one such exemplary technique will be hereinafter described. A wet-end stock system which could be used in the manufacture of the sized toilet tissue product 10 is illustrated in FIG. 4, and described previously herein. The toilet tissue 10' is formed on another machine used to manufacture a sized toilet tissue product, which is illustrated by the schematic process flow diagram of FIG. 6.

Figure 6:
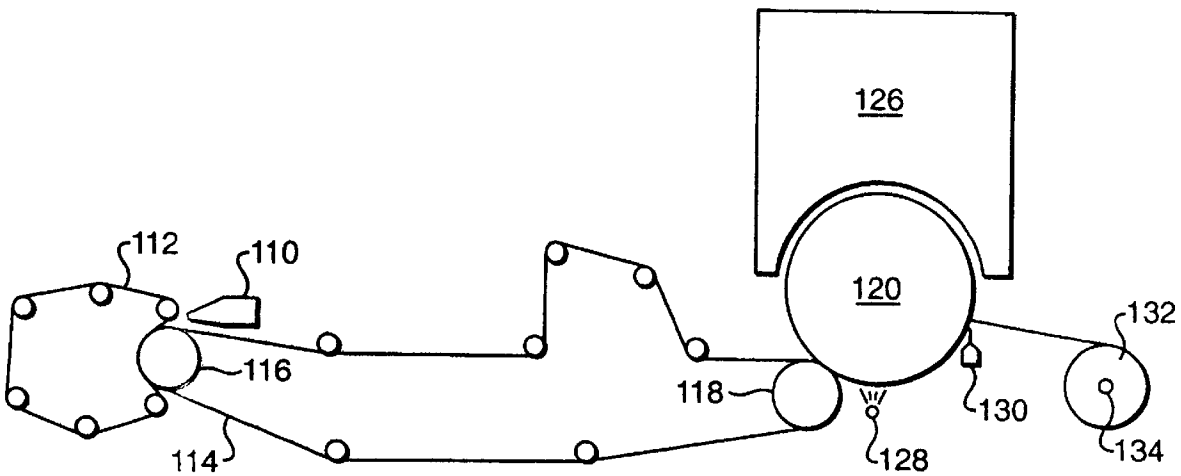
FIG. 6 is a schematic flow diagram of a creped tissue making process in accordance with this invention.

A crescent former is shown, having a monolayer headbox 110 which receives an outlet discharge 18 from fan pump 20 (FIG. 4) and which continuously injects or deposits a stream of an aqueous suspension of papermaking fibers between a forming fabric 112 and a press felt 114, which is partially wrapped around a form roll 116, as shown in FIG. 6. Water is removed from the aqueous stock suspension through the forming fabric 112 by centrifugal force as the newly form wet web traverses the arc of the form roll 116. The wet web is dewatered to a consistency of about 12 dry weight percent prior to being transported to a vacuum pressure roll 118.

After the forming fabric 112 and press felt 114 separate, the wet web 117 is transported on the press felt 114 to the vacuum pressure roll 118 where it is pressed against a yankee dryer 120 and further dewatered.

The steam heated yankee dryer 120 and high temperature air hood 126 are used to further dry the web. Generally, high temperatures, such as, for example, at least 180 degrees F., and preferably 200 degrees F. or more, may aid in the curing of the repellant agent.

An aqueous adhesive mixture is sprayed continuously onto the yankee dryer 120 via a spray boom 128 which evenly sprays an adhesive onto the dryer surface. The point of application onto the dryer surface is between a creping doctor blade 130 and the vacuum pressure roll 118. The adhesive mixture aids in the adhesion of the web to the yankee dryer 120 and thereby enhances the crepe performance when the web sheet is removed from the yankee dryer 120 via the creping doctor blade 130. The creped tissue is wound onto a roll 132 in the reel section 134 which runs at a speed of about 30 percent slower than the yankee dryer 120.

It will be appreciated that whether the tissue is made by an uncreped throughdried method, or a creped method, two or more plies may be crimped or ply bonded together. Techniques for crimping are disclosed in U.S. Pat. No. 5,622,734 to Clark et al., although other bonding techniques such as, for example, those disclosed in U.S. Pat. Nos. 5,698,291 and 5,543,202, all of which are hereby incorporated by reference herein, or by any other means known in the art, may be utilized.

EXAMPLES

Example 1A

A toilet tissue product 10 was produced on a tissue machine similar to that illustrated in FIGS. 4 and 5. A mixture of about 50% eucalptyus fibers and about 50% northern softwood kraft (hereinafter "LL19") were pulped for 30 minutes and placed in a holding chest which fed into chest 14. The fibers were then fed into the stuffbox 15. A hydrophobic chemical repellant agent, sold under the tradename REACTOPAQUE (RO) available from available from Sequa Chemicals, Inc., Chester, S.C., in an amount of about: 8 pounds of active agent per ton of fiber) and a debonder, imidazoline QAS, sold under the tradename C-6027, available from Witco Corp., Melrose Park, Ill., in the amount of about 3.25 pounds of active agent per ton of fiber were added between the chest 14 and the headbox 24. The fibers were fed from the stuffbox 15 to the outlet stream 18 and to the fan pump 20.

The monolayer headbox 24 injected this aqueous suspension of papermaking fibers onto the inner forming fabric 30. Water was removed from the deposited papermaking fibers through the forming roll 31. The wet web, dewatered to about 12% consistency was transferred to the transfer fabric 36 which travels at a slower speed than the forming fabric 30, and to the through drying fabric 40 which carried the web over the throughdryer to be dried. The resulting dried toilet tissue sheet was transferred to a reel drum from the through drying fabric 40 and wound into a roll 50, and is referred to as uncreped throughdried toilet tissue.

The single ply 11 tissue sheet product 10 had the following fiber composition: about 50% eucalyptus and about 50% LL19. The final base sheet had a basis weight of about 27 pounds/2880 ft. squared. Absorbency Rate, Absorbent Capacity, and Tensile Strength, (GMT) were tested at least 15 days after manufacture of the base sheet. As disclosed in Table 1, the Absorbency Rate of Example 1A was 405 seconds; the Absorbent Capacity was 11.46 gms/gms; and the Tensile Strength (GMT) was 320 g/3 in.

Example 1B

Uncreped throughdried toilet tissue was made as described in Example 1A, except that the amount of debonder was reduced to about 1.75 pounds of active agent per ton of fiber.

The final base sheet had a basis weight of about 27 pounds/2880 ft. squared. Absorbency rate, Absorbent Capacity, and Tensile Strength (GMT) were tested at least 15 days after manufacture of the base sheet. As disclosed in Table 1, the resulting sheet had the following properties: The Absorbency Rate of Example 1B was 10 seconds; the Absorbent Capacity was 11.92 gms/gms; and the Tensile Strength (GMT) was 540 g/3 in.

Example 1C

Uncreped throughdried toilet tissue was made as described in Example 1A, except that no debonder was added.

The final base sheet had a basis weight of about 27 pounds/2880 ft. squared. Absorbency Rate, Absorbent Capacity, and Tensile Strength (GMT) were tested at least 15 days after manufacture of the base sheet. As disclosed in Table 1, the resulting sheet had the following properties: The Absorbency Rate of Example 1C was 5 seconds; the Absorbent Capacity was 11.69 gms/gms; and the Tensile Strength (GMT) was 870 g/3 in.

Example 1D

Uncreped throughdried toilet tissue was made as described in Example 1A, except that the repellant agent was reduced to about 4 pounds of active agent per ton of fiber, and no debonder was added.

The final base sheet had a basis weight of about 27 pounds/2880 ft. squared. Absorbency rate, Absorbent Capacity, and Tensile Strength were tested at least 15 days after manufacture of the base sheet. As disclosed in Table 1, the resulting sheet had the following properties: The Absorbency Rate of Example 1D was 2 seconds; the Absorbent Capacity was 11.54 gms/gms; and the Tensile Strength (GMT) was 880 g/3 in.

Example 1E

Uncreped throughdried toilet tissue was made as described in Example 1A, except that no repellant agent was used, the debonder was increased to about 6 pounds of active agent per ton of fiber.

The final base sheet had a basis weight of about 27 pounds/2880 ft. squared. Absorbency Rate, Absorbent Capacity, and Tensile Strength (GMT) were tested at least 15 days after manufacture of the base sheet. As disclosed in Table 1, the resulting sheet had the following properties: The Absorbency Rate of Example 1E was 3 seconds; the Absorbent Capacity was 11.69 gms/gms; and the Tensile Strength (GMT) was 397 g/3 in.

Example 1F

Uncreped throughdried toilet tissue was made as described in Example 1A, except that no repellant agent was used, the debonder was increased to about 4 pounds of active agent per ton of fiber.

The final base sheet had a basis weight of about 27 pounds/2880 ft. squared. Absorbency Rate, Absorbent Capacity, and Tensile Strength (GMT) were tested at least 15 days after manufacture of the base sheet. As disclosed in Table 1, the resulting sheet had the following properties: The Absorbency Rate of Example 1F was 3 seconds; the Absorbent Capacity was 11.80 gms/gms; and the Tensile Strength (GMT) was 480 g/3 in.

Example 1G

Uncreped throughdried toilet tissue was made as described in Example 1A, except that no repellant agent was used, the debonder was decreased to about 1.5 pounds of active agent per ton of fiber.

The final base sheet had a basis weight of about 27 pounds/2880 ft. squared. Absorbency Rate, Absorbent Capacity, and Tensile Strength were tested at least 15 days after manufacture of the base sheet. As disclosed in Table 1, the resulting sheet had the following properties: The Absorbency Rate of Example 1G was 2 seconds; the Absorbent Capacity was 12.05 gms/gms; and the Tensile Strength (GMT) was 720 g/3 in.

Example 1H

Uncreped throughdried toilet tissue was made as described in Example 1A, except that no repellant agent was used, and no debonder was used.

The final base sheet had a basis weight of about 27 pounds/2880 ft. squared. Absorbency Rate, Absorbent Capacity, and Tensile Strength were tested at least 15 days after manufacture of the base sheet. As disclosed in Table 1, the resulting sheet had the following properties: The Absorbency Rate of Example 1H was 1.5 seconds; the Absorbent Capacity was 11.55 gms/gms; and the Tensile Strength (GMT) was 950 g/3 in.

TABLE 1

| | Example: | | | | | | | |
|---|---|---|---|---|---|---|---|---|
| | 1A | 1B | 1C | 1D | 1E | 1F | 1G | 1H |
| Repellant Agent | RO | RO | RO | RO | None | None | None | None |
| Repellant Agent Dosage (lb/MT) | 8 | 8 | 8 | 4 | 0 | 0 | 0 | 0 |
| Debonder | C-6027 | C-6027 | None | None | C-6027 | C-6027 | C-6027 | None |
| Debonder Dosage (lb/MT) | 3.25 | 1.75 | 0 | 0 | 6 | 4 | 1.5 | 0 |
| Absorbency Rate (sec) | 405 | 10 | 5 | 2 | 3 | 3 | 2 | 1.5 |
| Absorbency Capacity (gms/gms) | 11.46 | 11.92 | 11.69 | 11.54 | 11.69 | 11.80 | 12.05 | 11.55 |
| Tensile Strength (GMT) (g/3 in) | 320 | 540 | 870 | 880 | 397 | 480 | 720 | 950 |

Example 2A

A toilet tissue product 10' was produced on machines similar to those illustrated in FIGS. 4 and 6. A mixture of about 40% eucalptyus fibers and about 60% northern softwood kraft (LL19) were pulped for 30 minutes and placed in a holding chest which fed into chest 14. The fibers were then fed into the stuffbox 15. A hydrophobic chemical repellant agent, sold under the tradename REACTOPAQUE (RO), available from Sequa Chemicals, Inc., Chester, S.C., in an amount of about: 4 pounds of active agent per ton of fiber, a debonder, imidazoline QAS, sold under the tradename C-6027, available from Witco Corp., Melrose Park, Ill., in the amount of about 2.4 pounds of active agent per ton of fiber, a temporary wet strength agent, sold under the tradename of PAREZ 631-NC, available from Cytec Industries, West Paterson, N.J., in the amount of 0.5 pounds of active agent per ton of fiber, and another temporary wet strength (starch) agent, sold under the tradename REDIBOND 2005, available from National Starch, in the amount of about 2 pounds of active agent per ton of fiber were added between the chest 14 and the headbox 24. The fibers were fed from the stuffbox 15 to the outlet stream 18 and to the fan pump 20.

The monolayer headbox 110 injected this aqueous suspension of papermaking fibers between the forming fabric 112 and the press felt 114. The press felt 114 and the forming fabric 112 were traveling at 3000 ft/min and the headbox jet velocity was adjusted to reach the desired ratio of MD tensile to CD tensile, typically 2850 ft./min. Water was removed from the deposited papermaking fibers through the forming fabric 112 due to cetnrifugal force as the newly formed wet web traversed the arc of the forming roll 116. Upon separation of the forming fabric 112 and the press felt 114, the wet web, dewatered to about 12% consistency, was transported on the press felt 114 to the vacuum pressure roll 118. The vacuum pressure roll 118 further dewatered the wet web via mechanical pressing against the yankee dryer 120.

The steam heated yankee dryer 120 and gas fired high temperature air hood 126 dried the tissue web using temperatures reached at least 180 degrees F. An aqueous mixture of adhesive was continuously sprayed onto the yankee dryer 120 from spray boom 128. The single ply creped web was then wound into a roll 132 via a reel section 134 running at a speed approximately 30% slower than the yankee dryer 120. The ply 13 was combined with an identical ply 14 in a two ply configuration, as shown in FIG. 3. The resulting 2 ply toilet tissue product 10' is referred to as creped toilet tissue.

The two ply 13, 14 creped toilet tissue product 10' had the following fiber composition: about 40% eucalyptus and about 60% LL19. The final two ply base sheet had a basis weight of about 37 pounds/2880 ft. squared. Absorbency Rate, Absorbent Capacity, and Tensile Strength (GMT) were tested at least 15 days after manufacture of the base sheet. As disclosed in Table 2, the Absorbency Rate of Example 2A was 22 seconds; the Absorbent Capacity was 8.75 gms/gms; and the Tensile Strength (GMT) was 610 g/3 in.

Example 2B

Creped toilet tissue was made as described in Example 2A, except that no repellant agent was added.

The final base sheet had a basis weight of about 37 pounds/2880 ft. squared. Absorbency Rate, Absorbent Capacity, and Tensile Strength (GMT) were tested at least 15 days after manufacture of the base sheet. As disclosed in Table 2, the resulting sheet had the following properties: The Absorbency Rate of Example 2B was 8 seconds; the Absorbent Capacity was 7.6 gms/gms; and the Tensile Strength (GMT) was 1150 g/3 in.

Example 2C

Creped toilet tissue was made as described in Example 2A, except that no repellant agent and no temporary wet strength agents were added, and the debonder was increased to 4 pounds of active agent per ton of fiber.

The final base sheet had a basis weight of about 37 pounds/2880 ft. squared. Absorbency Rate, Absorbent Capacity, and Tensile Strength (GMT) were tested at least 15 days after manufacture of the base sheet. As disclosed in Table 2, the resulting sheet had the following properties: The Absorbency Rate of Example 2C was 9 seconds; the Absorbent Capacity was 8.9 gms/gms; and the Tensile Strength (GMT) was 480 g/3 in.

Example 2D

Creped toilet tissue was made as described in Example 2A, except that no repellant agent was added, no wet strength agents were added, and the debonder was increased to 2.5 pounds of active agent per ton of fiber.

The final base sheet had a basis weight of about 37 pounds/2880 ft. squared. Absorbency Rate, Absorbent Capacity, and Tensile Strength (GMT) were tested at least 15 days after manufacture of the base sheet. As disclosed in Table 2, the resulting sheet had the following properties: The Absorbency Rate of Example 2D was 8 seconds; the Absorbent Capacity was 7.9 gms/gms; and the Tensile Strength (GMT) was 680 g/3 in.

Example 2E

Creped toilet tissue was made as described in Example 2A, except that no repellant agent, no wet strength agents, and no debonder were added.

The final base sheet had a basis weight of about 37 pounds/2880 ft. squared. Absorbency Rate, Absorbent Capacity, Tensile strength, and Softness were tested at least 15 days after manufacture of the base sheet. As disclosed in Table 2, the resulting sheet had the following properties: The Absorbency Rate of Example 2E was 4.9 seconds; the Absorbent Capacity was 7.4 gms/gms; the Tensile Strength (GMT) was 1390 g/3 in.

TABLE 2

| | Example: | | | | |
|---|---|---|---|---|---|
| | 2A | 2B | 2C | 2D | 2E |
| Repellant Agent | RO | None | None | None | None |
| Repellant Agent Dosage (lb/MT) | 4 | 0 | 0 | 0 | 0 |
| Debonder | C-6027 | C-6027 | C-6027 | C-6027 | C-6027 |
| Debonder Dosage (lb/MT) | 2.4 | 2.4 | 4 | 2.5 | 0 |
| Absorbency Rate (sec) | 22 | 8 | 9 | 8 | 4.9 |
| Absorbency Capacity (gms/gms) | 8.75 | 7.60 | 8.90 | 7.90 | 7.40 |
| Tensile Strength (GMT) (g/3 in) | 610 | 1150 | 480 | 680 | 1390 |

It will be appreciated that the foregoing examples, given for the purposes of illustration, are not to be construed as limiting the scope of this invention, which is defined by the following claims and all equivalents thereto.

What is claimed is:

1. A method for making a toilet tissue product in a wet-end stock system including a chest and a headbox, comprising:

forming an aqueous suspension comprising papermaking fibers;

adding a repellant agent and a debonder to the aqueous suspension of papermaking fibers prior to forming a web and substantially uniformly dispersing the repellant agent and the debonder throughout the aqueous suspension of papermaking fibers;

depositing the aqueous suspension of papermaking fibers onto a forming fabric to form a web having a substantially homogeneous structure; and drying the web to form a toilet tissue product having an increased absorbency rate of at least 10 seconds with a reduced dry tensile strength.

2. The method of claim 1, wherein the repellant agent is a hydrophobic chemical.

3. The method of claim 2, wherein the repellant agent includes mono- and distearamides of aminoethylethanolamine.

4. The method of claim 1, wherein the amount of repellant agent added is from about 1 to about 20 pounds of agent per ton of papermaking fiber.

5. The method of claim 4, wherein the amount of repellant agent added is from about 4 to about 8 pounds of agent per ton of papermaking fiber.

6. The method of claim 1, wherein the debonder comprises a fatty chain quaternary ammonium salt.

7. The method of claim 6, wherein the fatty chain quaternary ammonium salt is an imidazoline quaternary ammonium salt.

8. The method of claim 1, wherein the amount of debonder added is from about 1 to about 10 pounds of debonder per ton of papermaking fiber.

9. The method of claim 8, wherein the amount of debonder added is from about 1.5 to about 6 pounds of debonder per ton of papermaking fiber.

10. The method of claim 1, wherein the repellant agent and the debonder are added to the aqueous suspension of papermaking at any point between the chest and the headbox.

11. A method for making a toilet tissue product in a wet-end stock system including a chest and a headbox, comprising:

forming an aqueous suspension comprising papermaking fibers;

adding about 4 to about 8 pounds of repellant agent per ton of papermaking fiber and about 1.5 to about 6 pounds of debonder per ton of papermaking fiber to the aqueous suspension of papermaking fibers prior to forming a web and substantially uniformly dispersing the repellant agent and the debonder throughout the aqueous suspension of papermaking fibers;

depositing the aqueous suspension of papermaking fibers onto a forming fabric to form a web having a substantially homogeneous structure; and drying the web to form a toilet tissue product having an increased absorbency rate of at least 10 seconds with a reduced dry tensile strength.

12. The method of claim 11, wherein the repellant agent is a hydrophobic chemical.

13. The method of claim 12, wherein the repellant agent includes mono- and distearamides of aminoethylethanolamine.

14. The method of claim 11, wherein the debonder comprises a fatty chain quaternary ammonium salt.

15. The method of claim 14, wherein the fatty chain quaternary ammonium salt is an imidazoline quaternary ammonium salt.

16. The method of claim 11, wherein the repellant agent and the debonder are added to the aqueous suspension of papermaking at any point between the chest and the headbox.

* * * * *